United States Patent [19]

Otaki et al.

[11] 4,262,481

[45] Apr. 21, 1981

[54] SPUN YARN-LIKE HIGH BULKY TEXTURED YARNS AND PROCESS FOR PRODUCING SAME

[75] Inventors: Yukio Otaki; Kazuo Umeda; Kiyoshi Nakagawa, all of Mishima, Japan

[73] Assignee: Toray Industries, Inc., Tokyo, Japan

[21] Appl. No.: 13,325

[22] Filed: Feb. 21, 1979

[51] Int. Cl.[3] ..... D02G 1/02; D02G 3/04; D02G 3/24

[52] U.S. Cl. ..... 57/245; 57/247; 57/285; 57/288; 57/289; 57/908

[58] Field of Search ..... 57/2, 284, 287, 288, 57/289, 285, 908, 245–247

[56] References Cited

U.S. PATENT DOCUMENTS

| | | | |
|---|---|---|---|
| 3,857,233 | 12/1974 | Cardinal et al. | 57/284 |
| 4,110,965 | 9/1978 | Bradley et al. | 57/2 X |
| 4,157,419 | 6/1979 | Mirhej | 57/245 X |
| 4,170,867 | 10/1979 | Leininger | 57/245 |

*Primary Examiner*—John Petrakes
*Attorney, Agent, or Firm*—Austin R. Miller

[57] ABSTRACT

Spun yarn-like high bulky textured polyester yarns comprised of two types of polyester multifilament component yarns A and B and having broken filaments, in which textured yarns there is a difference in length between the component yarns A and B, whereby very high bulkiness is imparted thereto. The individual filaments of the component yarn A have a fineness and an intrinsic viscosity less than those of the component yarns B. The spun yarn-like high bulky textured yarns have satisfactory pilling resistance and frosting resistance.

The spun yarn-like high bulky textured yarns can be produced by a process comprising doubling two types of undrawn polyester multifilament yarns having different properties through an intertwisting regulative device and simultaneously draw-texturing the doubled undrawn yarns.

13 Claims, 9 Drawing Figures

SPUN YARN-LIKE HIGH BULKY TEXTURED YARNS AND PROCESS FOR PRODUCING SAME

BACKGROUND OF THE INVENTION

1. Field of the Invention

The invention relates to spun yarn-like textured polyester yarns having broken filaments and high bulkiness and a process for the production thereof in which the broken filaments and high bulkiness are produced by simultaneous draw-texturing of two types of undrawn polyester multifilament yarns of different properties.

2. Description of Prior Art

Attempts have been made to impart effects resembling a spun yarn to a continuous multifilament yarn by producing broken filaments, loops, snarls or the like on the multifilament yarn. However, no satisfactory multifilament yarn having effects closely resembling a yarn obtained by spinning short fibers has hitherto been obtained. Particularly, it is difficult to impart to such a yarn fullness and softness, i.e. an effect such as resulting from the pore produced by the ends of the short fibers incorporated into the yarn by the genuine twist of spinning.

There are two methods for producing broken filaments on a continuous multifilament. One is a method of cutting some of the component filaments by bring the surface of the yarn into contact with a cutting device having a rough surface (see, for example, Japanese Patent Publication No. 48-15693); the other is a method wherein a doubled yarn consisting of a core component and a covering component is brought into contact with a similar cutting device to mainly cut the filaments of the covering component (see, for example, Japanese laid-open Patent Specification No. 49-133643). These methods have, however, a drawback in that it is difficult to control the resulting broken filament count.

As methods utilizing the difference in properties of the material yarns, there are a method wherein a yarn consisting of a multifilament component of a low strength and a multifilament component of an ordinary strength is false twisted and then passed through a stream of a high speed fluid to mainly cut the filaments of the low strength component (see, for example, Japanese laid-open Patent Specification No. 47-30957); a method wherein two mutlifilament undrawn yarns having different limiting draw ratios are doubled and then subjected to simultaneous draw-texturing at a draw ratio such that the filaments of the yarn of a low limiting draw ratio are cut but the filaments of the yarn of high limiting draw ratio are not cut (see, for example, Japanese laid-open Patent Specification No. 49-116351), and; a method wherein a multifilament yarn having, at least partially, a flex abrasion resistance cycle of less than 1,500 is false twisted to produce broken filaments (see, for example, U.S. Pat. No. 3,857,233). These methods have also drawbacks in that it is difficult to control the broken filament count of the resulting yarn, the resulting yarns are inferior in frosting resistance and/or they are inferior in processability due to the frequent occurrence of yarn breakage. Furthermore, the yarns obtained by these methods have insufficient fullness and softness as hereinbefore mentioned.

BRIEF SUMMARY OF THE INVENTION

The principal object of the present invention is to provide a spun yarn-like multifilament yarn having a desirable broken filament count, improved fullness and softness over those of the prior art and satisfactory pilling and frosting resistances.

It is another object of the present invention to provide a process for producing the above mentioned improved spun yarn-like multifilament yarn with a high processability.

According to the present invention, there is provided a spun yarn-like high bulky textured yarn comprised of two types of polyester multifilament component yarns A and B, the difference in monofilament denier $\Delta[d]_{B-A}$ of the component yarn B from the component yarn A being not less than 1.0 denier, the intrinsic viscosity $[IV]_A$ of the component yarn A being not less than 0.48 and the difference in intrinsic viscosity $\Delta[IV]_{B-A}$ of the component yarn B from the component yarn A being not less than 0.06, and the textured yarn having a broken filament count of not more than 25 per meter of its length, a difference in length of the component yarn A from the component yarn B of not more than 12% and a crimp stretchability of not more than 10%.

The present invention also provides a process for producing a spun yarn-like high bulky textured yarn as defined above, which comprises passing two types of undrawn polyester multifilament yarns A and B, the intrinsic viscosity $[IV]_A$ of the undrawn yarn A being not less than 0.48, the difference in intrinsic viscosity $\Delta[IV]_{B-A}$ of the undrawn yarn B from the undrawn yarn A being not less than 0.06 and the different in birefringence $\Delta[\Delta n]_{B-A}$ of the undrawn yarn B from the undrawn yarn A satisfying the expression: $2\times10^3 \leqq \Delta[\Delta n]_{B-A} \leqq 6\times10^3$, separately through a feed roller, simultaneously draw-texturing the undrawn yarns A and B together while doubling them with substantially identical intertwisting angles immediately after an intertwisting regulative device provided between the feed roller and a heater for fixing the twists, whereby the difference in monofilament denier $\Delta[d]_{B-A}$ of the yarn B from the yarn A is made not less than 1.0 denier and some of the individual filaments of the yarn A are partially cut to produce broken filaments, and taking up the draw-textured yarns A and B together.

A feature of the yarn according to the present invention resides in its very high bulkiness resulting from the difference in length between the two component yarns A and B. According to a specific embodiment of the present invention, the yarn may comprise as the component yarn A a multifilament yarn of polyester containing a copolymerized third component and having an intrinsic viscosity of not more than 0.54. Also, the yarn may comprise as the component yarn A a multifilament yarn in which the individual filaments have a tri-lobal to octa-lobal cross-section. Furthermore, the yarn may be made substantially coherent by, for example, subjecting the yarn to interlacing.

A feature of the process according to the present invention resides in the fact that the above-mentioned improved spun yarn-like multifilament yarn having desirable and uniform broken filaments can be obtained by simultaneously draw-texturing two undrawn polyester multifilament yarns of properly different properties together while using an intertwisting regulative device but employing no filament cutting device. In the present process, if desired, substantial coherence may be imparted to the yarn before the taking-up thereof.

DETAILED DESCRIPTION OF PREFERRED EMBODIMENTS

Figure 1A:
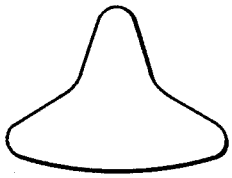
FIGS. 1A to 1E are schematic views illustrating cross-sections of filaments employable for the present invention.

The properties of the spun yarn-like high bulky textured yarns as defined in the present invention will become apparent from the following description.

The presence of the broken filaments in the yarn results in a smooth touch on a knitted or woven fabric obtained from the yarn. A yarn having a broken filament count of more than 25 per meter is not preferred, since such a yarn may have many neps and tend to often cause yarn breakage during the production thereof and in the case of being used for producing a knitted or woven fabric. The yarn according to the present invention preferably has a broken filaments count of 5 to 18 per meter.

The difference in length between the component yarns A and B largely affects the bulkiness of the resulting yarn and the bulkiness becomes high as the difference in length increases. However, if the difference in length of the resulting yarn exceeds 12%, the processability in the production of the yarn may be lowered due to the occurrence of yarn breakage or the forming of neps. Preferably, the difference in length is in a range of from 2 to 10%. The yarn of the present invention is very highly bulky, having a bulky effect due to the difference in length, in addition to the usual bulkiness inherent to a textured yarn.

The crimp stretchability is a measure for indicating the strength and degree of crimp. In the case where the crimp stretchability, measured as hereinafter described, is not more than 10%, the yarn has a desirable soft feel to the touch. However, if the crimp stretchability is less than 3%, the yarn is undesirably too soft.

In order to obtain a desirable feel to the touch, i.e. hand, and stiffness in a knitted or woven fabric from the yarn, it is necessary that the difference in monofilament denier $\Delta[d]_{B-A}$ between the component yarn B, having a higher intrinsic viscosity, and the component yarn A, having a lower intrinsic viscosity, be not less than 1.0 denier. The yarn of the present invention has desirable mixed crimp configurations resembling a natural fiber yarn, which result from the difference in heat settability originating in the difference in intrinsic viscosity $\Delta[IV]_{B-A}$ and the difference in monofilament denier between the component yarns A and B.

The intrinsic viscosity $[IV]_A$ of the component yarn A should be not less than 0.48 for maintaining the frosting resistance of the resulting yarn at a satisfactory level. The term "frosting" refers to a fault sometimes appearing in a synthetic filamentary yarn as a whitening phenomena of the component filaments due to their fibrilation. In order to obtain a yarn excellent in both pilling resistance and frosting resistance, it is preferable to employ, as the component yarn A, a multifilament yarn of polyester containing a copolymerized third component and having an intrinsic viscosity of not more than 0.54.

As the copolymerizable third component, there can be employed, for example, aliphatic dicarboxylic acids such as adipic acid, azelaic acid and sebacic acid, aromatic dicarboxylic acids such as phthalic acid and isophthalic acid, and polyfunctional compounds such as trimellitic acid and trimethyl trimellitate. The content of such a third component is peferably 1 to 10% mol.

Figure 1B:
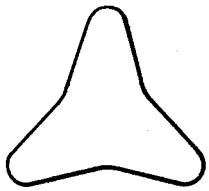
Figure 1C:
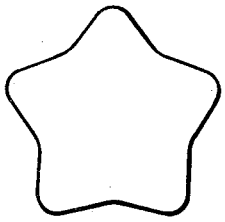
Figure 1D:
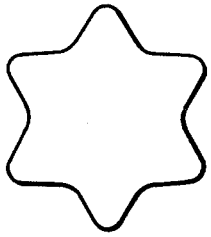
Figure 1E:
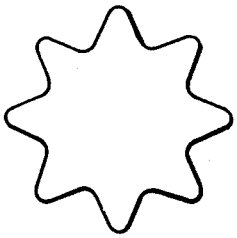

The individual filaments of the component yarn A may have tri-lobal to octa-lobal cross-sections if desirable to obtain a yarn of specific properties. If a yarn of filaments of tri-lobal cross-sections is employed as the component yarn A, the resulting yarn may be highly lustrous and have a silk-like unique appearance and hand. If the component yarn A is made of filaments having octa-lobal cross-sections, the glittery effect on the obtained yarn may be lowered, which glittery effect may often be produced on a textured yarn and is in general considered to be a fault. If desirable, in addition to the component yarn A, the component yarn B may also be made of filaments having a modified cross-section as mentioned above for the component yarn A. In FIGS. 1A to 1E, examples of the cross-sectional shapes of filaments usable for the undrawn yarns to be employed in the production of the yarn according to the present invention are shown. FIG. 1A shows a T-shaped tri-lobal cross-section and FIG. 1B shows a Y-shaped tri-lobal cross-section. These filamens can make the resulting yarn highly lustrous. FIG. 1C shows a penta-lobal cross-section, FIG. 1D shows a hexa-lobal cross-section and FIG. 1E shows an octa-lobal cross-section, and these filaments can produce a yarn of lowered or no glittery effect.

Preferably, the yarn according to the present invention may be made substantially coherent. The provision of such coherence makes the yarn easy to handle in a subsequent knitting or weaving process. For example, the unwinding of such a coherent yarn from a package can be easly carried out, in a manner similar to an ordinary textured yarn, notwithstanding the fact that the yarn has broken filaments and has been textured.

The coherence may be provided by subjecting the yarn to interlacing, twisting or sizing. Particularly, interlacing is preferred. In the yarn according to the invention, a "substantially coherent" condition or "substantial coherance" may be defined by the following values: in the case of interlacing, a CF value of not less than 50 as measured as hereinafter mentioned; in the case of twisting, a number of genuine twists of not less than 50 T/M, and; in the case of sizing, a coverage of a size of not less than 2.0% based on the weight of the yarn.

In the process according to the invention, two types of undrawn polyester multifilament yarns properly different in intrinsic viscosity and in birefringence are employed as material yarns. If the difference in birefrinence $\Delta[\Delta n]_{B-A}$ is less than $2.0\times10^{-3}$, broken filaments may be produced not only in the undrawn yarn A but also in the undrawn yarn B, and yarn breakage may often occur during the draw-texturing. On the other hand, if the difference in birefringence is more than $6.0\times10^{-3}$, a desirable broken filament count can not be obtained. Thus, by the use of undrawn yarns A and B having a difference in birefringence $\Delta[\Delta n]_{B-A}$ falling within a range of 2.0 to $6.0\times10^{-3}$, only the filaments in the undrawn yarn A can be selectively cut to impart a desirable broken filament count to the resulting yarn.

The difference in birefringence $\Delta[\Delta n]_{B-A}$ thus selected can also produce the following effect on the resulting yarn. Since the undrawn yarn A, which has a birefringence lower than that of the undrawn yarn, B, has a drawing stress relatively lower than that of the undrawn yarn B, the undrawn yarn A becomes arranged mainly at the outer portion of the doubled and intertwisted yarns during the twisting in the draw-texturng and, thus, the undrawn yarn A is stretched to a greater extent than the undrawn yarn B, whereby the difference in length as hereinbefore mentioned is produced.

To avoid the filament breakage of the undrawn yarn B, it is desirable that the undrawn yarn B have an intrinsic viscosity $[IV]_B$ of not less than 0.60 and also it is necessary that the difference in intrinsic viscosity $\Delta[IV]_{B-A}$ of the undrawn yarn B from the undrawn yarn A be not less than 0.06.

The birefringence $\Delta n$ in the undrawn yarns A and B is dependent on the combination of the spinning conditions, such as, the spinning speed, the fineness of the filaments to be spun and the like. For example, the birefringence $\Delta n$ of the yarn is increased as the fineness of the filaments is decreased in the case where the spinning speed is identical, while the birefringence $\Delta n$ of the yarn is increased as the spinning speed is increased in the case where the fineness of the filaments is identical. Thus, any combinations of the total deniers and the monofilament deniers of the undrawn yarns A and B having a desired difference in birefringence $\Delta[\Delta n]_{B-A}$ can be obtained by properly selecting the spinning conditions, such as spinning speed and the like.

In the process of the present invention, since the undrawn yarn A is stretched to a greater extent than the undrawn yarn B, as hereinbefore mentioned, the difference in monofilament denier $\Delta[d]_{B-A}$ can be naturally produced by at least using the undrawn yarn A having a monofilament denier less than that of the undrawn yarn B by not less than 1.0 denier.

The combination of different types of undrawn yarns A and B should preferably be selected so that the component yarns A and B of the resulting textured yarn have substantially identica dyeability.

In the process according to the present invention, an intertwisting regulative device is employed to ensure the commencement of the intertwisting of the two undrawn yarns A and B separately fed through a feed roller with substantially identical intertwisting angles. The intertwisting regulative device should be provided between the feed roller and a heater for fixing the twists imparted by a false-twister, so that the intertwisting of the two yarns can be started before the stretching of the yarns is started at the point the yarns are brought into contact with the heater. As such as intertwisting regulative devie, a pin, a pair of snail wires, a rod and the like may be employed.

The intertwisting regulative device should preferably have a surface of a low friction coefficient such as having a degree of surface roughness of 0.5 to 10S (according to Japanese Industrial Standard B 0601). A device such as a pin, rod or the like may be used in such a manner that it is inserted between the two yarns, whilea device such as a pair of snail wires or the like may be used in such a manner that the passages of the two yarns are separately fixed.

Figure 2A:
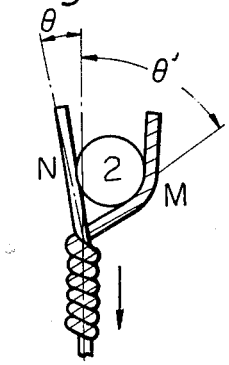
FIGS. 2A and 2B are schematic view illustrating the functions of an intertwisting regulative device.
Figure 2B:
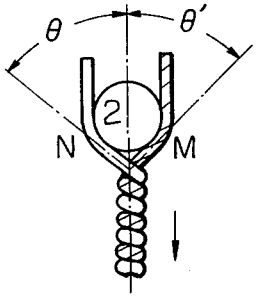

Referring now to FIG. 2B, a circular rod is employed as the intertwisting regulative device according to the invention. As is clearly seen from this figure, the twoyarns N and M are started, immediately after the rod, to be doubled and intertwisted with the respective intertwisting angles $\theta$ and $\theta'$. These angles should be substantially identical for achieving the purpose of the present invention. Particularly, the difference between the angles $\theta$ and $\theta'$ should be within 10°, preferably with 5°.

Similar means have hitherto been known, for example, in Japanese laid-open Patent Specification No. 49-50259 and Japanese laid-open Patent Specification No. 52-1126. However, these known means are used for the purpose that, upon the intertwisting of two yarns, one yarn is wound around the other yarn. Thus, as is seen from FIG. 2A, two yarns N and M are doubled and intertwisted with largely different intertwisting angles $\theta$ and $\theta'$ immediately after such a means.

In the process according to the present invention, if the means as mentioned above is employed instead of the intertwisting regulative device, i.e. if the intertwisting angles of the two undrawn yarns A and B are greatly different from each other as is seen in FIG. 2A, the difference in length between the yarns A and B is already produced at the point the intertwisting of the yarns is started and broken filaments are unlikely to be produced on the resulting textured yarn.

It has been found that, if the intertwisting of the two undrawn yarns A and B is stated with substantially identical intertwisting angles as is seen in FIG. 2B, broken filaments are desirably produced on the component yarn A during the simultaneous draw-texturing. The use of the intertwisting regulative device in the process of the present invention for the purpose of the commencement of the intertwisting of two yarns with substantially identical intertwisting angles can produce the following further effects. Yarn breakage is unlikely to occur, so that the processability becomes high. A difference in dyeability between the two component yarns is unlikely to be produced on the resulting textured yarn. A uniform broken filament count can be obtained along the yarn length.

Contrary to this, in the case where the intertwisting regulative device is not used, a difference in dyeability between the two component yarns is likely to be produced on the resulting textured yarn; a uniform broken filament count can not be obtained, and; yarn breakage often occurs during the draw-texturing.

It has further been surprisingly found that, if the intertwisting of the two undrawn yarns A and B is started with substantially identical intertwisting angles according to the invention, simultaneous draw-texturing can be successfully carried out with a high processability, even if undrawn yarns having a birefringence of less than $15\times10^{-3}$ are used as the starting undrawn yarns A and B, which undrawn yarns of a low birefringence are, in general, considered to be unsuitable for employment as the starting yarns for the usual draw-texturing.

A preferred embodiment of the process according to the present invention will now be further illustrated with reference to FIG. 3.

An undrawn polyester multifilament yarn A of a relatively low intrinsic viscosity and an undrawn polyester multifilament yarn B of a relatively high intrinsic viscosity are separately fed through a feed roller 1. The yarns A and B are doubled together immediately after an intertwisting regulative device 2, provided between the feed roller 1 and a first heater 3 for fixing the twists imparted by a false-twister 4. The doubled yarns A and B are then simultaneously drawn and false-twisted between the intertwisting regulative device 2 and a second roller 5 provided downstream of the false-twister 4. The yarns A and B are then passed through an interlacing nozzle 6, provided downstream of the second roller 5 for imparting substantial coherence to the two yarns to form a composite yarn. The composite yarn is then passed through a third roller 7 and, if desired, heat treated by a second heater 8, provided between the third roller 7 and a forth roller 9, and then, taken up on a take-up means 10. Indicated in FIG. 3 by g are yarn guides.

The doubled and intertwisted yarns A and B are subjected to untwisting after being passed through the false-twister 4 and, during this draw-texturing, filament breakage occurs in the component yarn A to produce desired broken filaments and a difference in length between the component yarns A and B is produced. Thus, a spun yarn-like high bulky textured yarn according to the invention is obtained.

The above-mentioned interlacing nozzle 6 and second heater 8 may be omitted as appropriate. Also, instead of the interlacing, twisting or sizing may be carried out for imparting substantial coherence to the yarn, as hereinbefore mentioned. Further, the interlacing nozzle 6 may be provided between the false-twister 4 and the second roller 5 or at an inlet or outlet portion of the second heater 8, or the positions of the interlacing nozzle 6 and the second heater 8 may be interchanged. If desirable, coning oil may be applied to the yarn before it is taken up.

As the false-twister 4, an external friction false-twister, internal friction false-twister or false-twisting spindle may be employed. In the process according to the invention, it is not necessary to employ any particular means for producing broken filaments. Thus, where a friction false-twister is employed for the draw-texturing, the friction body of the false-twister may be made of soft material such as rubber to produce a desirable broken filament count on the resulting yarn. The use of such a rubber friction false-twister can produce an advantage in that the yarn is unlikely to be harmed by the false-twister and, thus, the strength of the resulting yarn is high.

The properties as discussed herein with respect to the spun yarn-like high bulky textured yarns and starting undrawn yarns are determined by the following methods.

INTRINSIC VISCOSITY [IV]

This is determined by dissolving a sample yarn in o-chlorophenol and measuring the viscosity values at 25°±0.1° C. (see, ASTM D1243).

BIREFRINGENCE Δn

This is measured in a usual manner using a polarizing microscope. Since it is difficult to measure the birefringence of a yarn of filaments having modified cross-sections, a yarn of filaments having circular cross-sections is produced under conditions the same as those employed in the production of the yarn of filaments having modified cross-sections and the birefringence of the yarn of filaments of circular cross-sections is measured.

BROKEN FILAMENT COUNT

Protruded broken filaments are counted with the unaided eye over 5 m of the yarn length and an average number of the counted broken filaments per meter is indicated.

CRIMP STRETCHABILITY 20 m of a sample yarn is formed into a hank of a circuit length of 1 m, a load of 1/15 gram per denier is applied and the hank with the load is heat treated for 5 minutes in an oven at 105°±2° C. The hank is taken out from the oven and allowed to cool to room temperature. Then, a length $l_a$ of this hank is measured. Thereafter, a load of 4 grams per denier is added to the hank and a length $l_b$ of this hank is measured. The crimp stretchability is calculated by the following equation.

$$\text{Crimp Stretchability } (\%) = (l_b - l_a)/l_b \times 100$$

CF VALUE

Figure 4:
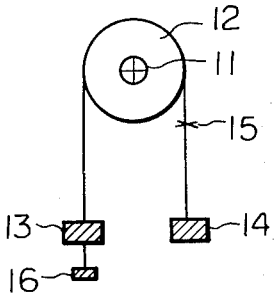
FIG. 4 is a schematic view of a device for the measurement of a CF value as hereinafter defined.

As illustrated in FIG. 4, a sample yarn is hung on a sheave 12 which is freely rotatable around a central axis 11 and two loads 13 and 14 are applied to the two ends of the sample yarn. The respective loads are 0.4 gram per denier. Then, a fixing needle 15 of a diameter of 0.60 mm is pierced at a right angle into the yarn so that the constituent filaments are divided into approximately two equal parts and the needle is fixed. An additional load 16 of 2 grams per denier is then applied to the left side end (in FIG. 4) of the yarn, whereby the yarn moves counter clockwise (in FIG. 4) around the sheave 12 to a point an interlaced portion of the yarn is caught by the fixing needle to stop the movement of the yarn.

Then, the additional load 16 is removed from the left side end of the yarn and applied to the right side end of the yarn, whereby the yarn moves clockwise around the sheave 12 to a point where another interlaced portion of the yarn is caught by the fixing needle to stop the movement of the yarn. The speed of movement of the yarn caused by the additional load is constant at 10 mm/sec.

The length (l mm) of the movement of the yarn caused by the replacement of the additional load 16 is measured and the CF value calculated from the following equation.

$$\text{CF Value} = 1000/(l + 0.60)$$

DIFFERENCE IN LENGTH

A sample yarn is marked at two points 30 cm apart with the yarn under a load of 0.1 gram/denier. Then, the load is removed and the component yarns A and B are carefully separated from each other. Each of the separated component yarns is loaded with a weight of 0.1 gram/denier and the length between the marked points is measured. The percentage of difference in length between the two component yarns A and B is calculated from the following equations.

$$\text{Difference in Length}(\%) = (L_A - L_B)/L_B \times 100$$

wherein $L_A$ is a measured length of the component yarn A and $L_B$ is a measured length of the component yarn B.

If the separation of the respective component yarns A and B is difficult, the marking of the yarn may be effected over a shorter length of the yarn.

PILLING RESISTANCE

This is measured using an ICI-type pilling tester and classified as follows.

5: Excellent (acceptable)
4: Very good (acceptable)
3: Good (acceptable)
2: Slightly inferior (not acceptable)
1: Inferior (not acceptable)

FROSTING RESISTANCE

A sample yarn is rubbed against a woven fabric made of a polyester textured yarn for 20 minutes and the degree of the produced whitening is observed. The evaluation is as follows.

◎ : Very good (No whitening is observed; acceptable)

○ : Fairly good (little whitening is observed; acceptable)

Δ: Good (Whitening is slightly observed; acceptable)

X: Inferior (Whitening is clearly observed; not acceptable)

PROCESSABILITY

This is evaluated by the occurrence of yarn breakage during the production process and by the degree of the produced neps on the resulting yarn.

◎ : Yarn breakage does not occur and no nep is observed.

○: Yarn breakage does not occur but a few small neps are observed.

Δ: Yarn breakage sometimes occurs or a few neps are observed.

X: Yarn breakage often occurs or many neps are observed.

EXAMPLE 1

Seven types of polyethylene terephthalate, each different in intrinsic viscosity, were spun at a spinning speed of 1250 m/min to obtain undrawn multifilament yarns A of 200 deniers-36 filaments. An undrawn multifilament yarn B of 200 deniers-18 filaments was also obtained by spinning polyethylene terephthalate at a spinning speed of 1450 m/min. The intrinsic viscosity of the yarn B was 0.63 and the birefringence of the yarn B was $9.6\times10^{-3}$.

Figure 3:
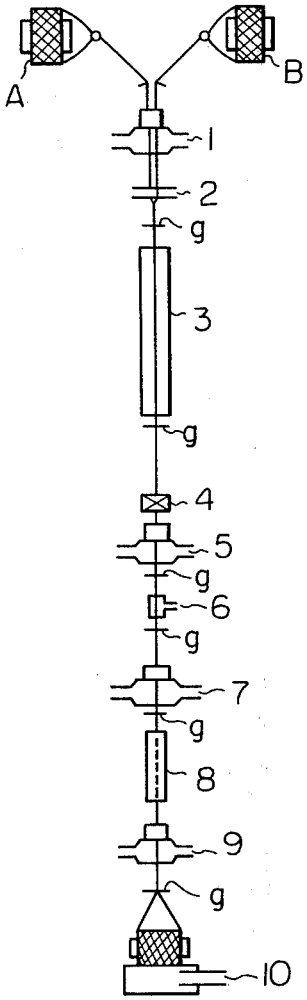
FIG. 3 is a schematic view of an apparatus usable for the practice of a preferred embodiment of the process of the present invention.

Using each of the yarns A together with the yarn B, simultaneous draw-texturing was carried out on an apparatus as illustrated in FIG. 3 under the following conditions.

| | |
|---|---|
| Peripheral speed of feed roller (1) | 121.2 m/min |
| Peripheral speed of second roller (5) | 400.0 m/min |
| Peripheral speed of third roller (7) | 399.0 m/min |
| Peripheral speed of forth roller (9) | 398.0 m/min |
| Length of first heater (3)[a] | 1.5 m |
| Surface temperature of first heater (3)[a] | 205° C. |
| Intertwisting regulative device (2) | b |
| False twister (4) | c |
| Interlacing nozzle (6) | not used |
| Second heater (8) | not used |
| Take-up tension | 8–10 g |
| Number of false twists | 2680–2720 T/M |

Notes
[a]Grooved hot plate
[b]Textured rod of a diameter of 7 mm and a degree of surface roughness of 2.5 S
[c]External friction false-twister having 3 shafts and 4 urethane rubber discs Results are shown in Table 1 below.

TABLE 1

| No. | Undrawn yarn $[IV]_A$ | $\Delta[IV]_{B-A}$ | $\Delta[\Delta n]_{B-A}\times10^{-3}$ | Pilling resistance | Frosting resistance | Difference in length (%) | Broken filament count (count/m) | Crimp stretch-ability (%) |
|---|---|---|---|---|---|---|---|---|
| 1 | 0.47 | 0.16 | 3.3 | 5 | X | 8.3 | 9.0 | 4.8 |
| 2 | 0.49 | 0.14 | 3.1 | 5–4 | Δ | 8.6 | 8.2 | 4.8 |
| 3 | 0.50 | 0.13 | 3.0 | 5–4 | Δ | 8.2 | 8.0 | 4.6 |
| 4 | 0.52 | 0.11 | 2.9 | 4 | ○–Δ | 8.3 | 8.2 | 5.2 |
| 5 | 0.54 | 0.09 | 2.7 | 4–3 | ○–Δ | 8.1 | 7.6 | 5.1 |
| 6 | 0.57 | 0.06 | 2.5 | 3 | ◎ | 7.8 | 6.6 | 4.9 |
| 7 | 0.60 | 0.03 | 2.2 | 3–2 | ◎ | 8.0 | 6.6 | 4.9 |

The difference in monofilament denier $\Delta[d]_{B-A}$ between the component yarns A and B in each of the obtained yarns was 1.5 denier.

From the above table, it is seen that insufficient frosting resistance is produced in the use of an undrawn yarn A of an intrinsic viscosity $[IV]_A$ of 0.47 (No. 1), while unsatisfactory pilling resistance is produced in the case where the difference in intrinsic viscosity $\Delta[IV]_{B-A}$ is less than 0.06 (No. 7). In the case of No. 7, some broken filaments were observed in the component yarn B of the obtained texture yarn.

EXAMPLE 2

Undrawn multifilament yarns A of 200 deniers–48 filaments were obtained by spinning polyethylene terephthalate of an intrinsic viscosity of 0.51 at two different spinning speeds. Undrawn multifilament yarns B of 200 deniers–18 filaments were also obtained by spinning polyethylene terephthalate of an intrinsic viscosity of 0.63 at various spinning speeds. Using each of these undrawn yarns A in combination with each of the undrawn yarns B, draw-texturing as described in Example 1 was carried out.

Results are shown in Table 2 below.

TABLE 2

| No. | Undrawn yarn A Spinning speed (m/min) | Birefringence $[\Delta n]_A\times10^{-3}$ | Undrawn yarn B Spinning speed (m/min) | Birefringence $[\Delta n]_B\times10^{-3}$ | Difference in bire-fringence $\Delta[\Delta n]_{B-A}\times10^{-3}$ | Process-ability | Difference in mono-filament denier $\Delta[d]_{B-A}$ | Dif-ference in length (%) | Broken filament count (count/m) | Crimp stretch-ability (%) |
|---|---|---|---|---|---|---|---|---|---|---|
| 8 | 1150 | 5.9 | 1150 | 7.2 | 1.3 | Δ | 2.1 | 1.9 | 26.2 | 4.8 |
| 9 | 1150 | 5.9 | 1250 | 8.1 | 2.2 | ○ | 2.2 | 6.3 | 18.8 | 4.8 |
| 10 | 1150 | 5.9 | 1350 | 8.9 | 3.0 | ◎ | 2.2 | 8.8 | 11.0 | 4.6 |
| 11 | 1150 | 5.9 | 1450 | 9.6 | 3.7 | ◎ | 2.2 | 9.2 | 6.4 | 4.6 |
| 12 | 1150 | 5.9 | 1550 | 10.3 | 4.4 | ◎ | 2.2 | 9.4 | 4.4 | 5.1 |
| 13 | 1000 | 3.9 | 1150 | 7.2 | 3.3 | ◎ | 2.2 | 9.0 | 8.2 | 4.7 |
| 14 | 1000 | 3.9 | 1250 | 8.1 | 4.2 | ◎ | 2.2 | 9.8 | 5.6 | 4.3 |

TABLE 2-continued

| No. | Undrawn yarn A Spinning speed (m/min) | Undrawn yarn A Birefringence $[\Delta n]_A \times 10^{-3}$ | Undrawn yarn B Spinning speed (m/min) | Undrawn yarn B Birefringence $[\Delta n]_B \times 10^{-3}$ | Difference in birefringence $\Delta[\Delta n]_{B-A} \times 10^{-3}$ | Processability | Difference in monofilament denier $\Delta[d]_{B-A}$ | Difference in length (%) | Broken filament count (count/m) | Crimp stretchability (%) |
|---|---|---|---|---|---|---|---|---|---|---|
| 15 | 1000 | 3.9 | 1350 | 8.9 | 5.0 | ○ | 2.2 | 10.7 | 4.0 | 4.5 |
| 16 | 1000 | 3.9 | 1450 | 9.6 | 5.7 | ○ | 2.3 | 11.8 | 4.2 | 4.4 |
| 17 | 1000 | 3.9 | 1550 | 10.3 | 6.4 | Δ | 2.3 | 13.6 | 2.8 | 4.1 |

In the case of No. 8, processability was inferior and many broken filaments were undesirably produced. In the case of No. 17, processability was also inferior and the difference in length was too great so that undesirable neps were produced.

EXAMPLE 3

Undrawn multifilament yarns A of 200 deniers–36 filaments were obtained by spinning six types of polyethylene terephthalate containing 2% mol of copolymerized isophthalic acid, and each different in intrinsic viscosity, at a spinning speed of 1050 m/min. The employed polyethylene terephthalate contained 0.5% by weight of titanium dioxide.

An undrawn multifilament yarn B of 200 deniers–18 filaments was obtained by spinning polyethylene terephthalate containing 0.5% by weight of titanium dioxide, but containing no copolymerized third component, at a spinning temperature of 290° C. and a spinning speed of 1450 m/min. The intrinsic viscosity and the birefringence of the obtained yarn B were 0.62 and $9.6 \times 10^{-3}$, respectively.

Each of the undrawn yarns A in combination with the undrawn yarn B was draw-textured on an apparatus as illustrated in FIG. 3 under the following conditions.

| | |
|---|---|
| Peripheral speed of feed roller (1) | 121.2 m/min |
| Peripheral speed of second roller (5) | 400.0 m/min |
| Peripheral speed of third roller (7) | 392.0 m/min |
| Peripheral speed of forth roller (9) | 352.8 m/min |
| Length of first heater (3)[a] | 1.5 m |
| Surface temperature of first heater (3)[a] | 205° C. |
| Intertwisting regulative device (2) | *b* |
| False twister (4) | *c* |
| Number of false twists | 2770 T/M |
| Interlacing nozzle (6) | *d* |
| Tension of yarn under interlacing | 2 g |
| Length of second heater (8)[e] | 1.2 m |
| Temperature of second heater (8)[e] | 185° C. |

-continued

| | |
|---|---|
| Take-up tension | 8–10 g |

Notes
[a]Grooved hot plate
[b]Textured rod of a diameter of 4 mm and a degree of surface roughness of 7S
[c]External friction false-twister having 3 shafts and 6 urethane rubber discs
[d]Air of a pressure of 3.5 kg/cm$^2$ was blown against the yarn through a narrc opening at a flow rate of 21 normal liters/min.
[e]Hollow form heater The obtained yarn was knitted into a circular knitte fabric and the fabric was dyed a black shade. Then, th fabric was subjected to pilling and frosting tests.

Results are shown in Table 3 below.

TABLE 3

| No. | Undrawn yarn A $[IV]_A$ | Undrawn yarn A Spinning temperature (°C.) | Undrawn yarn A $[\Delta n]_A \times 10^{-3}$ | Difference in birefringence $\Delta[\Delta n]_{B-A} \times 10^{-3}$ | Pilling resistance | Frosting resistance | Broken filament count (count/m) | Difference in length (%) | Crimp stretchability (%) |
|---|---|---|---|---|---|---|---|---|---|
| 18 | 0.48 | 273 | 5.3 | 4.3 | 5–4 | ○ | 9.2 | 8.6 | 5.2 |
| 19 | 0.50 | 277 | 5.5 | 4.1 | 5–4 | ○ | 8.6 | 8.6 | 5.0 |
| 20 | 0.52 | 280 | 5.7 | 3.9 | 4–3 | ○ | 8.8 | 8.3 | 4.8 |
| 21 | 0.54 | 284 | 5.8 | 3.8 | 4–3 | ○ | 9.2 | 8.2 | 5.0 |
| 22 | 0.56 | 288 | 6.0 | 3.6 | 3–2 | ⊙ | 11.4 | 8.4 | 4.6 |
| 23 | 0.58 | 288 | 6.1 | 3.5 | 3–2 | ⊙ | 12.4 | 8.0 | 5.3 |

The difference in monofilament denier $\Delta[\Delta d]_{B-A}$ between the component yarns A and B in each of the obtained yarns was 2.1 denier.

From the above table, it is seen that, in the case where an undrawn yarn A of polyethylene terephthalate containing a copolymerized third component and having an intrinsic viscosity $[IV]_A$ of not more than 0.54 is employed, the resulting textured yarn can be satisfactory in both the pilling resistance and the frosting resistance.

EXAMPLE 4

Undrawn multifilament yarns A of 200 deniers–36 filaments were obtained by spinning polyethylene terephthalate, containing various copolymerized third components as shown in Table 4 below and 0.5% by weight of titanium dioxide, at a spinning speed of 1050 m/min. The birefringence of each of the obtained yarns A was $5.2 \times 10^{-3}$.

An undrawn multifilament yarn B of 200 deniers–18 filaments was obtained by spinning polyethylene terephthalate, containing 0.5% by weight of titanium dioxide but containing no copolymerized thrid component, at a spinning speed of 1450 m/min. The intrinsic viscosity and the birefringence of the obtained yarn B were 0.62 and $9.6 \times 10^{-3}$, respectively.

Using each of the undrawn yarns A in combination with the undrawn yarn B, draw-texturing and pilling and frosting tests were carried out, in the same manner as described in Example 3.

Results are shown in Table 4.

TABLE 4

| No. | Third component | | Intrinsic viscosity of yarn A $[IV]_A$ | Pilling resistance | Frosting resistance | Difference in length (%) | Broken filament count (count/m) | Crimp stretch-ability (%) |
|---|---|---|---|---|---|---|---|---|
| 24 | None | | 0.48 | 5–4 | Δ | 8.3 | 6.6 | 4.8 |
| 25 | Isophthalic acid | 1% mol | 0.49 | 5–4 | ⊙ | 8.1 | 7.2 | 5.2 |
| | Trimethyl trimellitate | 1% mol | | | | | | |
| 26 | Adipic acid | 6% mol | 0.50 | 5–4 | ○ | 8.1 | 7.8 | 4.6 |
| | Trimethyl trimellitate | 1% mol | | | | | | |
| 27 | Diethylene glycol | 6% mol | 0.52 | 4–3 | ○ | 7.8 | 8.0 | 4.7 |

The difference in monofilament denier $\Delta[d]_{B-A}$ between the component yarns A and B in each of the obtained yarns was 2.0 denier. From the above table, it is seen that, in the case where an undrawn yarn A containing a copolymerized third component is employed, the frosting resistance of the resulting yarn is improved.

EXAMPLE 5

Undrawn multifilament polyethylene terephthalate yarns A of 200 deniers–36 filaments were obtained at a spinning temperature of 273° C. and at various spinning speeds. The employed polyethylene terephthalate contained, in addition to 0.5% by weight of titanium dioxide, copolymerized third components of 1% mol of isophthalic acid and 1% mol trimethyl trimellitate. The cross-sections of the individual filaments were in an octa-lobal form as illustrated in FIG. 1E and the intrinsic viscosity of the yarn was 0.49.

An undrawn multifilament yarn B of 200 deniers–18 filaments was obtained by spinning polyethylene terephthalate, containing 0.5% by weight of titanium dioxide but containing no copolymerized third component, at a temperature of 290° C. and a speed of 1450 m/min. The individual filaments of the yarn had circular cross-sections, and the intrinsic viscosity and the birefringence were 0.62 and $9.5\times10^{-3}$, respectively.

Each of the undrawn yarns A in combination with the undrawn yarn B was then subject to draw-texturing as mentioned in Example 3 but without using the second heater.

Results are shown in Table 5 below.

TABLE 5

| No. | Undrawn yarn A: Spinning speed (m/min) | Undrawn yarn A: Birefringence $[\Delta n]_A \times 10^{-3}$ | Difference in birefringence $\Delta[\Delta n]_{B-A} \times 10^{-3}$ | Process-ability | Broken filament count (count/m) | Difference in length (%) | Crimp stretch-ability (%) | Difference in mono-filament denier $\Delta[d]_{B-A}$ |
|---|---|---|---|---|---|---|---|---|
| 28 | 1550 | 8.1 | 1.4 | Δ–X | 58.6 | 1.6 | 5.9 | 1.8 |
| 29 | 1450 | 7.2 | 2.3 | ○ | 24.0 | 4.5 | 5.2 | 2.0 |
| 30 | 1350 | 6.6 | 2.9 | ⊙ | 21.6 | 6.7 | 5.1 | 2.0 |
| 31 | 1250 | 6.4 | 3.1 | ⊙ | 18.4 | 7.4 | 4.8 | 2.0 |
| 32 | 1150 | 6.0 | 3.5 | ⊙ | 17.2 | 8.0 | 4.7 | 2.0 |
| 33 | 1050 | 5.2 | 4.3 | ⊙ | 15.6 | 8.8 | 4.3 | 2.0 |
| 34 | 950 | 5.0 | 4.5 | ⊙ | 10.8 | 8.8 | 4.6 | 2.0 |
| 35 | 850 | 4.4 | 5.1 | ⊙ | 8.6 | 9.2 | 4.9 | 2.1 |
| 36 | 750 | 3.7 | 5.8 | ⊙ | 8.8 | 10.9 | 4.1 | 2.1 |
| 37 | 650 | 3.2 | 6.3 | ⊙ | 1.8 | 12.8 | 4.1 | 2.2 |

From Table 5 above, it is seen that, in the case where the difference in birefringence $\Delta[\Delta n]_{B-A}$ is less than $2\times10^{-3}$, the processability is inferior and the broken filaments are undesirably increased.

On the other hand, if the difference in birefringence $\Delta[\Delta n]_{B-A}$ is more than $6\times10^{-3}$, it is difficult to produce desirable broken filament count in the resulting yarn. In such a case, although the broken filament count can be increased by increasing the draw ratio in the draw-texturing, it was confirmed that at such a high draw ratio the breaking of the filaments of the yarn B undersirably occurred.

EXAMPLE 6

An undrawn multifilament yarn B of 200 deniers–18 filaments was prepared by spinning polyethylene terephthalate, containing 3.0% by weight of polyethylene glycol and 0.5% by weight of titanium dioxide, at a temperature of 290° C. and a speed of 1450 m/min. The yarn B had an intrinsic viscosity of 0.63 and a birefringence of $9.1\times10^{-3}$, and the individual filaments had octa-lobal cross-sections.

Using the undrawn yarn B together with an undrawn yarn A which was the same as that in No. 33 of Example 5, draw-texturing as described in Example 3 was carried out. However, in this example (No. 38), coning oil was applied to the yarn before taking up in an amount of 0.8% based on the weight of the yarn.

A spun yarn-like high bulky textured yarn was obtained. The yarn had a broken filament count of 15.0 count/m, a strength of 2.9 g/d, a difference in monofilament denier $\Delta[d]_{B-A}$ of 2.1d, a crimp stretchability of 4.6%, a CF value of 185, an unwinding tension of 5.2 g and a difference in length of about 8.3%. Only a very slight difference in dyeability between the two component yarns was observed.

Using the obtained textured yarn as both filling and warp, a 2/2 twill fabric was woven. The fabric had excellent hand, being highly bulky and voluminous, soft and having a feel to the touch resembling a woven fabric obtained from a spun yarn.

Futher, the obtained textured yarn was softly rewound into a cheese and then steamed. The yarn thus treated was then knitted into an interlock fabric. The obtained fabric was soft and had a feel to the touch resembling a knitted fabric obtained from a spun yarn.

The woven and knitted fabrics had no glittery effect thereon.

EXAMPLE 7

Using the undrawn yarns as described in Example 6, draw-texturing was carried out under the following conditions on an apparatus as illustrated in FIG. 3.

| | |
|---|---|
| Peripheral speed of feed roller (1) | 121.2 m/min |
| Peripheral speed of second roller (5) | 400.0 m/min |
| Peripheral speed of third roller (7) | 392.0 m/min |
| Peripheral speed of forth roller (9) | 352.8 m/min |
| Length of first heater (3)[a] | 1.5 m |
| Surface temperature of first heater (3)[a] | 205° C. |
| False twister (4) | b |
| Number of false twists | 2660–2720 T/M |
| Interlacing nozzle (6) | c |
| Tension of yarn under interlacing | 2 g |
| Take-up tension | 8–10 g |

Notes
[a]Grooved hot plate
[b]External friction false-twister having 3 shafts and 4 urethane rubber discs
[c]Air of a pressure of 3.5 kg/cm$^2$ was blown against the yarn through a narrow opening at a flow rate of 31 normal liters/min.

In test No. 39 (comparison), no intertwisting regulative device was used and the undrawn yarns were doubled before the feed roller, while overfeeding the undrawn yarn A through another feed roller at a feeding speed 3% faster than the feeding speed of the undrawn yarn B.

In tesst No. 40 (comparison) and test No. 41 (the invention), a textured alumina rod of a diameter of 7 mm and a degree of surface roughness of 2.5 S was used as the intertwisting regulative device. In these tests, the undrawn yarns A and B were doubled with intertwisting angles $\theta$ and $\theta'$ shown in Table 6, below, immediately after the texured alumina rod.

Results are shown in Table 6.

TABLE 6

| No. | Intertwisting angles $\theta$ | Intertwisting angles $\theta'$ | Difference in color shade* | Broken filament count (count/m) |
|---|---|---|---|---|
| 39 | — | — | Remarkable | 52.4 |
| 40 | 12° | 33° | Slightly remarkable | 0.8 |
| 41 | 25° | 25° | Not remarkable | 14.8 |

Note
*The obtained yarn was formed into a circular knitted fabric and the knitted fabric was dyed with a disperse dye (Amacron Blue RLS, C.I. Disperse Blue 70). Then, the difference in color shade between the component yarns A and B was observed by the naked eye.

In test No. 39, the difference in color shade was remarkable, much broken filaments were produced.

In test No. 40, broken filaments were only very seldom produced and the difference in color shade was slightly remarkable.

What is claimed is:

1. A spun yarn-like high bulky textured yarn comprised of two types of polyester multifilament component yarns A and B, the difference in monofilament denier $\Delta[d]_{B-A}$ of the component yarn B from the component yarn A being not less than 1.0 denier, the intrinsic viscosity $[IV]_A$ of the component yarn A being not less than 0.48 and the difference in intrinsic viscosity $\Delta[IV]_{B-A}$ of the component yarn B from the component yarn A being not less than 0.06, and the textured yarn having a broken filament count of not more than 25 per meter of its length, a difference in length of the component yarn A from the component yarn B of not more than 12% and a crimp stretchability of not more than 10%.

2. A textured yarn according to claim 1, wherein the broken filament count is in a range of 5 to 18 per meter.

3. A textured yarn according to claim 1, wherein the difference in length is in a range of 2 to 10%.

4. A textured yarn according to claim 1, wherein the crimp stretchability is in a range of 3 to 10%.

5. A textured yarn according to claim 1, wherein the multifilament component yarn A is made of polyester containing a copolymerized third component.

6. A textured yarn according to claim 5, wherein the intrinsic viscosity $[IV]_A$ of the component yarn A is not more than 0.54.

7. A textured yarn according to claim 1, wherein at least the component yarn A is made of filaments having a tri-lobal to octa-lobal cross-section.

8. A textured yarn according to claim 1 or 7, wherein the textured yarn is made substantially coherent.

9. A process for producing a spun yarn-like high bulky textured yarn comprised of two types of polyester multifilament component yarns A and B, the difference in monofilament denier $\Delta[d]_{B-A}$ of the component yarn B from the component yarn A being not less than 1.0 denier, the intrinsic viscosity $[IV]_A$ of the component yarn A being not less than 0.48 and the difference in intrinsic viscosity $\Delta[IV]_{B-A}$ of the component yarn B from the component yarn A being not less than 0.06, and the textured yarn having a broken filament count of not more than 25 per meter of its length, a difference in length of the component yarn A from the component yarn B of not more than 12% and a crimp stretchability of not more than 10%, which comprises:

passing two types of undrawn polyester multifilament yarns A and B, the intrinsic viscosity $[IV]_A$ of the undrawn yarn A being not less than 0.48, the difference in intrinsic viscosity $\Delta[IV]_{B-A}$ of the undrawn yarn B from the undrawn yarn A being not less than 0.06 and the difference birefringence $\Delta[\Delta n]_{B-A}$ of the undrawn yarn B from the undrawn yarn A satisfying the expression: $2\times10^{-3}\leqq\Delta[\Delta n]_{B-A}\leqq6\times10^{-3}$, separately through a feed roller;

simultaneously draw-texturing the undrawn yarns A and B together while doubling them with substantially identical intertwisting angles immediately after an intertwisting regulative device provided between the feed roller and a heater for fixing the twists, whereby the difference in monofilament denier $\Delta[\Delta d]_{B-A}$ of the yarn B from the yarn A is made not less than 1.0 denier and some of the individual filaments of the yarn A are partially cut to produce broken filaments, and;

taking up the draw-textured yarns A and B together.

10. A process according to claim 9, wherein the undrawn multifilament yarn A is made of polyester containing a copolymerized third component.

11. A process according to claim 10, wherein the intrinsic viscosity $[IV]_A$ of the undrawn yarn A is not more than 0.54.

12. A process according to any one of claims 9 or 11, wherein at least the undrawn yarn A is made of filaments having a tri-lobal to octa-lobal cross-section.

13. A process according to claim 9, wherein substantial coherence is imparted to the draw-textured yarns before taking up.

* * * * *

UNITED STATES PATENT AND TRADEMARK OFFICE

CERTIFICATE OF CORRECTION

PATENT NO. : 4,262,481

DATED : 4/21/81

INVENTOR(S) : Yukio Otaki et al

It is certified that error appears in the above—identified patent and that said Letters Patent is hereby corrected as shown below:

Column 2, line 29 "different" should read --difference--.

Column 5, line 62 "whilea" should read --while a--.

Column 6, line 1 "twoyarns" should read --two yarns--.

Column 6, line 6 "with" should read --within--.

Column 6, line 27 "stated" should read --started--.

Column 8, line 39 "l" should read --ℓ--.

Column 8, line 44 "l" should read --ℓ--.

Column 16, line 23 "$\Delta[d]_{B-A}$" should read --$\Delta[d]_{A-B}$--.

Signed and Sealed this

Eighteenth Day of August 1981

[SEAL]

Attest:

GERALD J. MOSSINGHOFF

Attesting Officer

Commissioner of Patents and Trademarks